US007171885B1

(12) United States Patent
Obiol

(10) Patent No.: US 7,171,885 B1
(45) Date of Patent: Feb. 6, 2007

(54) SYSTEM FOR FIXING ROTARY CUTTING DIES IN MACHINES FOR DIE CUTTING LAMINAR MATERIAL

(75) Inventor: Ramon Serra Obiol, Martorell (ES)

(73) Assignee: Cimco, S.L., Martorell (ES)

( * ) Notice: Subject to any disclaimer, the term of this patent is extended or adjusted under 35 U.S.C. 154(b) by 0 days.

(21) Appl. No.: 09/463,914

(22) PCT Filed: May 28, 1999

(86) PCT No.: PCT/ES99/00157

§ 371 (c)(1),
(2), (4) Date: Feb. 1, 2000

(87) PCT Pub. No.: WO99/62778

PCT Pub. Date: Dec. 9, 1999

(30) Foreign Application Priority Data

Jun. 1, 1998 (ES) ..... 9801136

(51) Int. Cl.
*B26D 7/26* (2006.01)

(52) U.S. Cl. ..... 83/698.11; 83/698.41; 83/698.51; 83/331

(58) Field of Classification Search ..... 83/698.41, 83/698.42, 698.61, 698.31, 663, 698.11, 659, 83/331, 954, 698.51, 699.51, 481, 698.71, 83/699.11; 403/31, 312
See application file for complete search history.

(56) References Cited

U.S. PATENT DOCUMENTS 1,980,885 A * 11/1934 Smith ..... 83/346
2,984,176 A * 5/1961 Sommer et al. ..... 83/699.11
3,752,028 A * 8/1973 Waizmann et al. ..... 83/685
3,793,918 A * 2/1974 Huffman ..... 83/698
3,889,333 A * 6/1975 Katz et al. ..... 407/31
3,983,926 A * 10/1976 Muller ..... 164/386
4,020,724 A * 5/1977 Quinlan ..... 83/346
4,131,047 A * 12/1978 Schriber et al. ..... 83/698
4,474,565 A * 10/1984 Watson et al. ..... 493/342
4,485,714 A * 12/1984 Eriksson ..... 83/699.11
4,594,928 A * 6/1986 Thomas et al. ..... 83/698
4,742,747 A * 5/1988 Kirsch ..... 83/699.11
4,878,407 A * 11/1989 Harrison et al. ..... 83/663
4,962,683 A * 10/1990 Scheffer et al. ..... 83/103
5,003,854 A * 4/1991 Capdebosco ..... 83/331
5,282,409 A * 2/1994 Rojas ..... 83/698
5,394,779 A * 3/1995 Meeks ..... 83/332
5,465,641 A * 11/1995 Herd ..... 83/698.61
5,570,620 A * 11/1996 Okonski et al. ..... 83/698.42
5,771,770 A * 6/1998 Muller ..... 83/698.61
5,782,156 A * 7/1998 Collins ..... 83/331
5,875,699 A * 3/1999 Koelsch ..... 83/698.41
6,190,087 B1 * 2/2001 Rower ..... 404/104

* cited by examiner

*Primary Examiner*—Boyer D. Ashley
*Assistant Examiner*—Omar Flores Sánchez
(74) *Attorney, Agent, or Firm*—Egbert Law Offices

(57) ABSTRACT

System for fixing rotary die cutters in die cutting machines for cutting laminar material includes a fixing means between the die (1) and a die-holder surface or cylinder (2) around which the die (1) is arranged, wherein the a fixing element include a plurality of bolts (3) actuated by an actuator (5) housed inside a hollow body (8) fixed to the die-holder cylinder (2) in order to provide for a rapid fixing of the rotary die to the die-holder cylinder.

8 Claims, 4 Drawing Sheets

SYSTEM FOR FIXING ROTARY CUTTING DIES IN MACHINES FOR DIE CUTTING LAMINAR MATERIAL

TECHNICAL FIELD

The present invention relates to a system for fixing rotary cutting dies in machines for die cutting laminar material, the purpose of which lies in its configuration as a system that permits fixing rotary cutting dies on the cylinders or cutting die supports in machines for die cutting laminar material.

This invention is applied within the industry dedicated to the manufacture of die cutting machines, especially machines for die cutting laminar material.

BACKGROUND ART

In rotary cutting die machines, the material to be cut, for example cardboard for making boxes, is moved between a cutting die support cylinder and a counter-cutting die cylinder or anvil, also rotary, so that at each turn of the cylinders the cutting die falls on the counter-cutting die and makes a cut or warping on the cardboard.

To avoid the problem of the cutting die becoming damaged by the blow, the surface of the counter-cutting die is provided with a polyurethane coating.

At present, the rotary cutting dies are fixed on the cutting die support by means of screws that are coupled to the corresponding screw holes made on the surface of the cutting die support cylinder. This fixing system has the main inconvenience of being excessively slow, as a considerable number of screws has to be placed.

The statement made in the above paragraph confirms that the stopping time of the machine when a new cutting die has to be mounted is excessive and this affects the productivity of the rotary cutting die machine.

SUMMARY OF THE INVENTION

The system for fixing rotary cutting dies in machines for die cutting laminar material proposed by the invention is formed in itself as an obvious novelty that manages to resolve the above mentioned inconvenience and, furthermore, presents other advantages to be described later on.

The system for fixing rotary cutting dies in machines for die cutting laminar material includes fixing means between the cutting die and a cutting die support cylinder, where the fixing means has a number of bolts operated by a driving device.

This characteristic permits rapid fixing of the rotary cutting die to the cutting die support cylinder, with the result that the shutdown time of the machine to change the cutting die is less than at present, thus, improving the productivity of the cutting die machine.

The system of the invention also has the peculiarity that each of the working devices is housed inside a hollow body fixed to the cutting die support cylinder.

Because of this characteristic the manufacturing costs of the cutting die machine are not overexpensive, in turn permitting that maintenance and mechanization of the machine are quick and easy.

Preferably, the working devices are also dynamic fluid cylinders that operate independently in the two halves of the cutting die support cylinder.

According to their performance, the dynamic fluid cylinders are pneumatic of hydraulic cylinders and it is also preferred that the working devices be dynamic fluid cylinders that operate independent of the two halves of the cutting die support cylinder.

Likewise, according to their performance, the dynamic fluid cylinders are pneumatic or hydraulic cylinders and it should be indicated that it is also preferred that the bolts are placed on the rotary cutting die in a grid pattern with the result that the bolts occupy the whole surface of the cutting die in a uniform way.

According to a performance, the system of the invention also includes screwed drill holes to fix the rotary cutting die to the cutting die support cylinder, placing these screwed drill holes to ensure fixing of the rotary cutting die to the cutting die support cylinder in the event the system is not used.

Preferably, the drill holes are also placed on the cutting die support cylinder in a grid pattern, occupying the places that have not been used by the bolts.

BRIEF DESCRIPTION OF THE DRAWINGS

To complement the description which follows and in order to help with a better understanding of the characteristics of the invention, this descriptive report includes a set of drawings in which the following is represented in an illustrative but not limiting way.

DETAILED DESCRIPTION OF THE DRAWINGS

Figure 1:
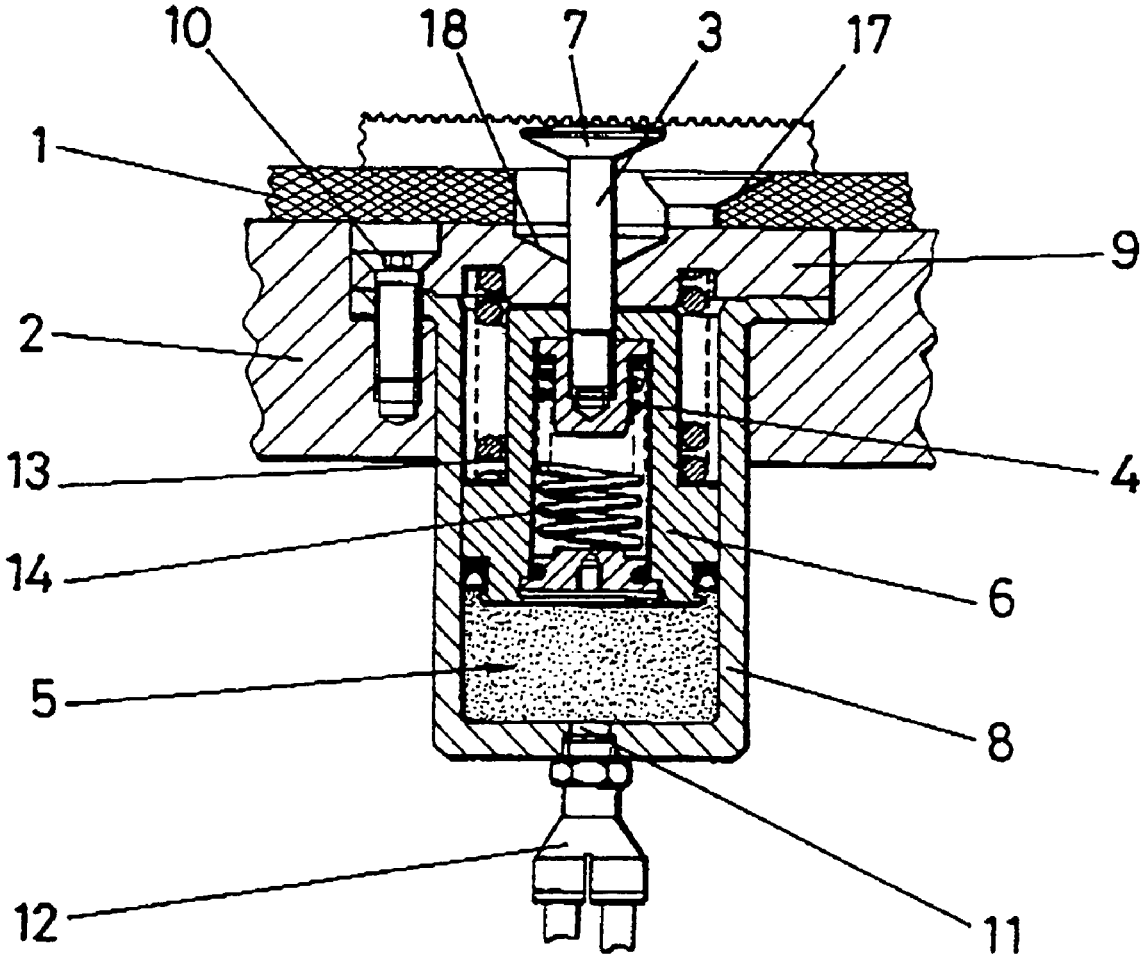
FIG. 1 shows an elevated section view of a working device.

In view of these figures, it can be seen how the system for fixing rotary cutting dies in machines for die cutting laminar material is made up of rotary cutting dies (1) which are fixed to cutting die support cylinders (2) by means of a number of bolts (3) worked by a pneumatic cylinder (5).

The bolts (3) are fixed to the piston (6) of the pneumatic cylinder (5) by a screw nut (4) the head (7) of which has a larger diameter that fixes the cutting die (1) to the cutting die support cylinder (2).

The pneumatic cylinders (5) are housed inside two hollow bodies (8) and each of these hollow bodies (8) is fixed to the cutting die support cylinder (2) by means of four fixing screws (10).

Figure 2:
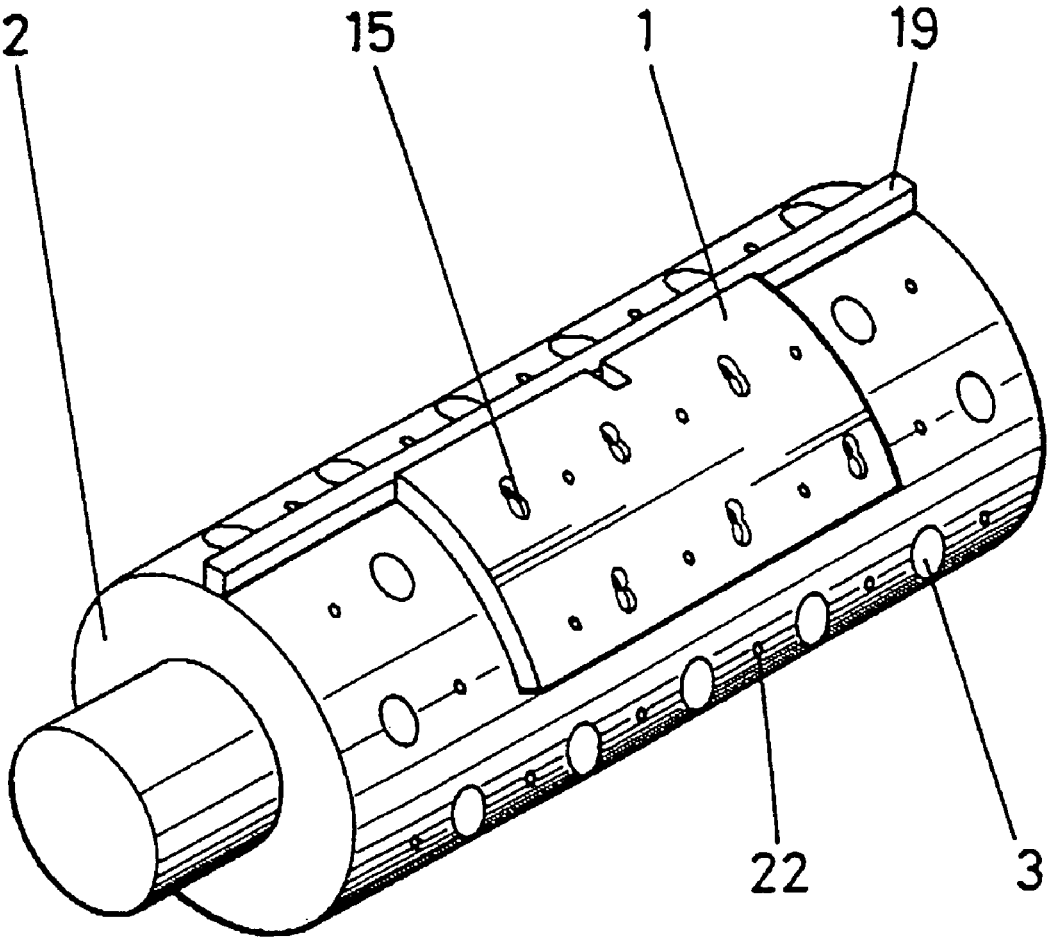
FIG. 2 shows a perspective view of a cutting die placed on a cutting die support cylinder.

As can be seen in figure 2, the bolts (3) are placed on cutting die support cylinders (2) and on the rotary cutting die (1) in a grid pattern, so that they occupy the whole surface of the cutting die (1) in a uniform way.

Figure 3:
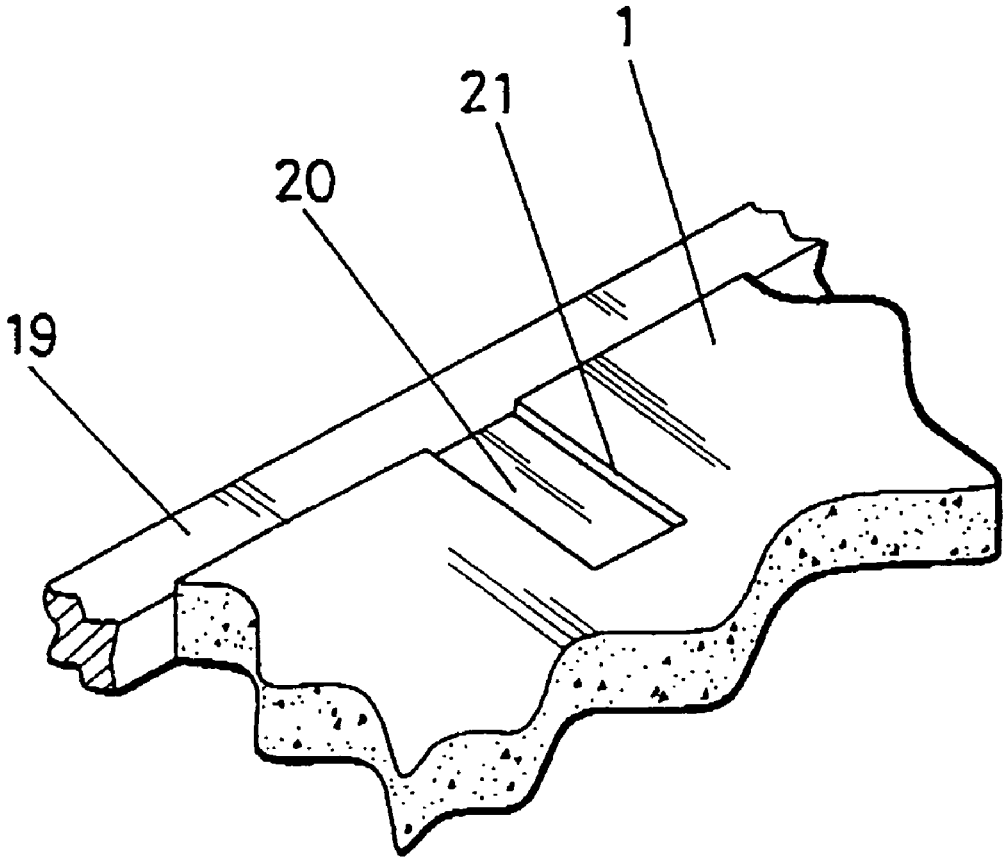
FIG. 3 shows a detailed view of the centering system of the cutting die on the cutting die support cylinder.
Figure 4:
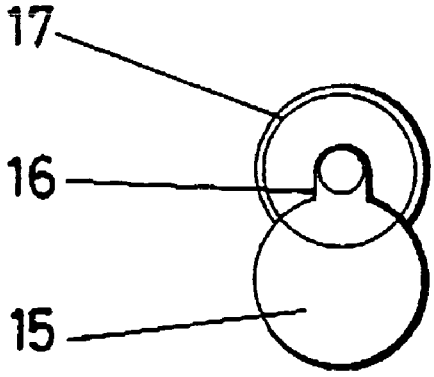
FIG. 4 shows a fixing hole of the cutting die.
Figure 8:
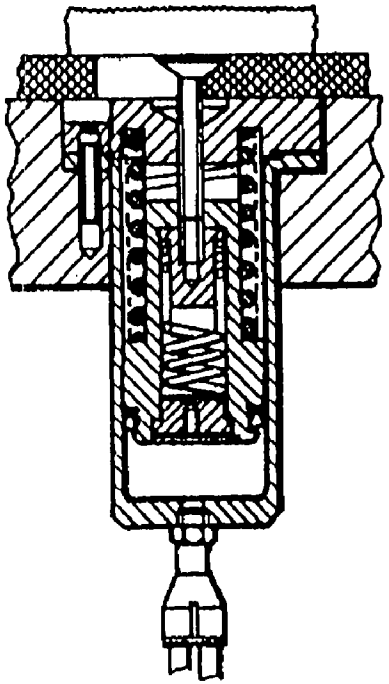
FIGS. 5, 6, 7 and 8 correspond to elevated section views of the four working positions of the working device relating to the system for fixing rotary cutting dies in machined for die cutting laminar material.

In FIG. 3 it can be seen that, in order to center the cutting die (1) on the cutting die support cylinder (2), there is a circumferential stop (19) and an axial stop (20) for centering the cutting die (1), while the cutting die (1) has a centering guide (21).

The fixing system can also include screwed drill holes (22) to fix the rotary cutting die (1) to the cutting die support cylinder (2) and, in this case, the screwed drill holes (22) are also placed on the cutting die support cylinder (2) and on the rotary cutting die (1) in a grid pattern occupying the places that have not been previously occupied by the bolts (3).

At the bottom of each pneumatic cylinder (5) there is an orifice (11) connected to a duct (12) for injecting pressurized air. In the event that the bolt (3) does not find any hole (15) in the cutting die (1) through which it can exit, the system of the invention has a hollow piston (6) that has a spring (14) inside which gives way and permits the bolt (3) to remain hidden inside the piston (6) and in a hollow (18) in the lid (9) of the pneumatic cylinder. This lid (9) is fixed to the cutting die (1) with the same screws (10) as the hollow body (8).

The holes (15) of the cutting die (1) have a slot (16) provided with an adapter (17) in the shape of the head (7) of the bolt (3).

Figure 5:
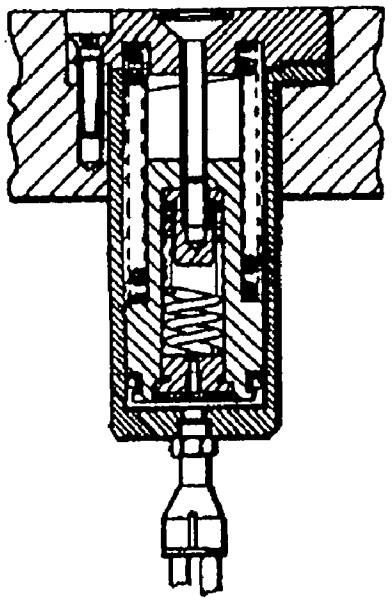

The different work stages of the working devices can be seen in FIG. 5.

The above mentioned stages of the working devices are as follows:

First stage. While the pneumatic cylinder (FIG. 5) has no pressurized air, the spring (13) pushes the bolt (3) towards the inside of the hollow body (8). The cutting die (1) is placed on the cutting die support cylinder (2), butting against the circumferential stop (19) and the centering axial stop (20) of the cutting die support cylinder (2).

Figure 7:
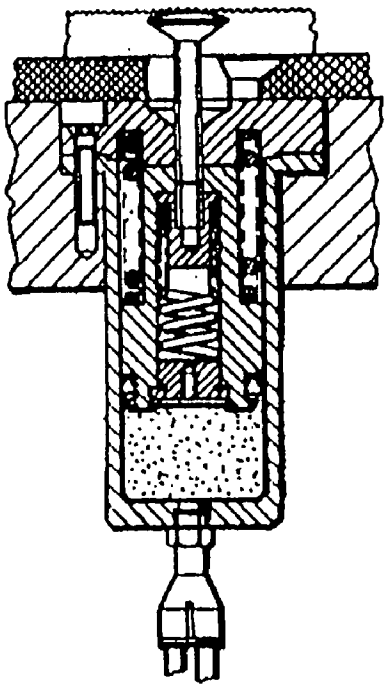

Second stage. The pneumatic cylinder, as shown in FIGS. 6 and 7, receives the pressurized air through an orifice (1) made at the bottom of the pneumatic cylinder (5), connected to a duct (12), driving this pressurized air upwards to the piston (6) and, at the same, the bolt (3), thus overcoming the stress of the spring (13), as shown in FIG. 7.

Figure 6:
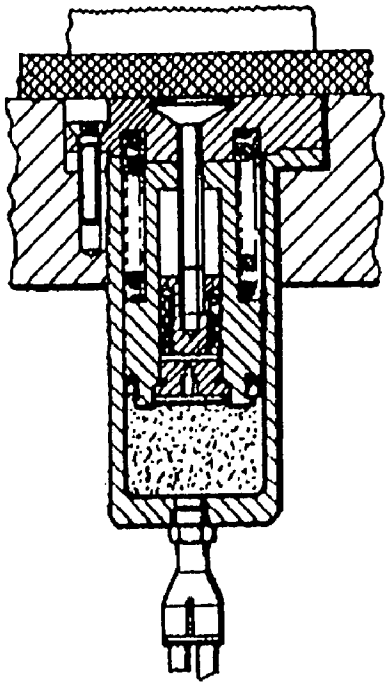

In the hypothetical case that the outlet of the bolt (3) was obstructed, the pressurized air would continue to overcome the stress of the spring (13), thus maintaining the piston up, but the bolt (3) would remain hidden inside the piston (6), thus placing a little pressure produced by the spring (14) on the cutting die (1), as shown in FIG. 6.

I claim:

1. An apparatus for die cutting laminar material comprising:

a cutting die support cylinder having a cylindrical outer surface, said cutting die support cylinder having a two 180° halves;

a cutting die having a curved shape, said cutting die having a curved inner surface conforming to said cylindrical outer surface of said cutting die support cylinder, said cutting die having a plurality of holes formed therein so as to extend from said curved inner surface to an exterior surface of said cutting die;

a fixing means for securing said cutting die to said cutting die support cylinder, said fixing means comprising:

a bolt having a shank and a head, said head having a larger area than an area of a cross-section of said shank in parallel relation to said head; and a working means housed within a hollow body affixed to said cutting die support cylinder, said working means operatively connected to said bolt for moving said bolt from a retracted position to an extended position, said head of said bolt extending outwardly of said cutting die support cylinder through one of said plurality of holes of said cutting die when in said extended position, said working means being a dynamic fluid cylinder, said head of said bolt being secured to said cutting die when in said extended position, said working means comprising a plurality of fluid dynamic cylinders each acting independently of each other in said two 180° halves, each of said plurality of fluid dynamic cylinders having a spring cooperative with said bolt such that said bolt remains in said retracted position when said bolt is obstructed from moving to the extended position.

2. The apparatus of claim 1, said dynamic fluid cylinder being a pneumatic cylinder.

3. The apparatus of claim 1, said dynamic fluid cylinder being a hydraulic cylinder.

4. The apparatus of claim 1, said plurality of holes of said cutting die being quincuxes, said head of bolt being resiliently retained in one of said quincuxes when said bolts is in said retracted position.

5. The apparatus of claim 1, said cutting die support cylinder having a plurality of threaded holes formed thereon, said cutting die having respective fasteners received by said plurality of threaded holes so as to secure said cutting die to said cutting support cylinder.

6. The apparatus of claim 1, said plurality of threaded holes having respective quincurixes formed at said surface of said cutting die support cylinder.

7. The apparatus of claim 1, said cutting die being centered on said cutting die support cylinder.

8. The apparatus of claim 7, said cutting die support cylinder having a circumferential stop and an axial stop, said cutting die having an edge abutting said circumferential stop and a centering guide receiving said axial stop.

* * * * *